United States Patent [19]

Reba et al.

[11] 4,387,065

[45] Jun. 7, 1983

[54] SYSTEM AND METHOD FOR CONTINUOUSLY PREVENTING FILAMENT BRIDGING BETWEEN ADJACENT DRAW NOZZLES

[75] Inventors: Imants Reba; Edward C. Wolthausen, both of Vancouver, Wash.

[73] Assignee: Crown Zellerbach Corporation, San Francisco, Calif.

[21] Appl. No.: 317,361

[22] Filed: Nov. 2, 1981

[51] Int. Cl.[3] ..... B28B 7/04

[52] U.S. Cl. ..... 264/39; 226/7; 226/97; 264/27; 264/169; 264/210.8; 425/66; 425/225

[58] Field of Search ..... 19/299; 65/5; 264/12, 264/27, 39, 176 F, 169, 167, 210.8; 425/725, 225, 66; 226/7, 97

[56] References Cited

U.S. PATENT DOCUMENTS

| | | | |
|---|---|---|---|
| 3,224,852 | 12/1965 | Stalege | 65/5 |
| 4,185,981 | 1/1980 | Ohsato et al. | 264/12 |
| 4,285,452 | 8/1981 | Reba et al. | 19/299 |
| 4,334,340 | 6/1982 | Reba | 19/299 |

FOREIGN PATENT DOCUMENTS

| | | | |
|---|---|---|---|
| 1504295 | 9/1969 | Fed. Rep. of Germany | 65/4.1 |

*Primary Examiner*—Jay H. Woo

*Attorney, Agent, or Firm*—Jerome S. Marger

[57] ABSTRACT

A system and method are provided for continually preventing filament bridging between adjacent draw nozzles. The system comprises a heating element, generally in the form of a metal heating wire, which is disposed between adjacent nozzles and is positioned in the path of filaments attempting to bridge the nozzles. The temperature is maintained at a level high enough above the melting point of the filaments so that they will continuously and instantaneously melt when they contact the heating element.

10 Claims, 3 Drawing Figures

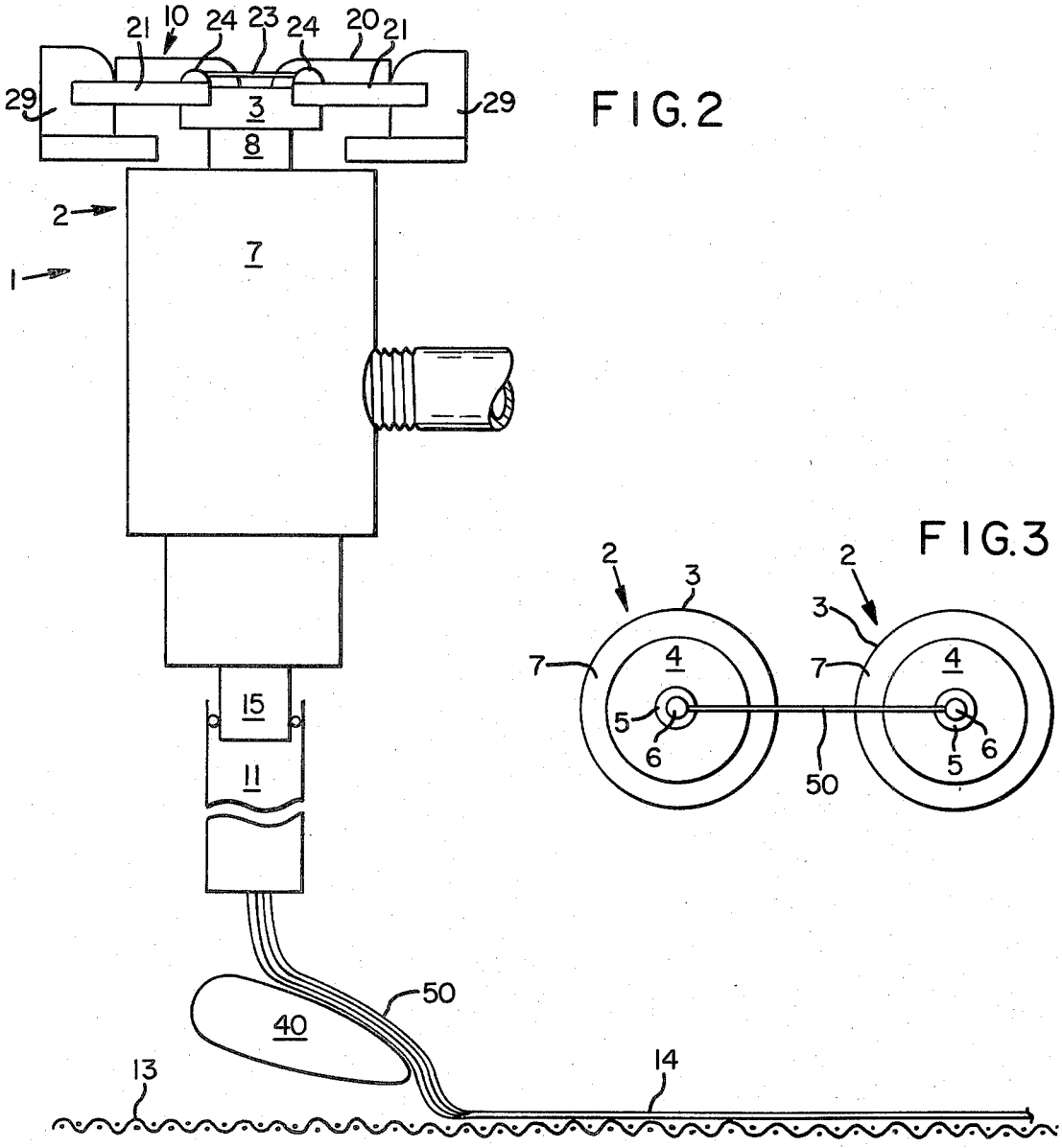
FIG. 2
FIG. 3
FIG. 1
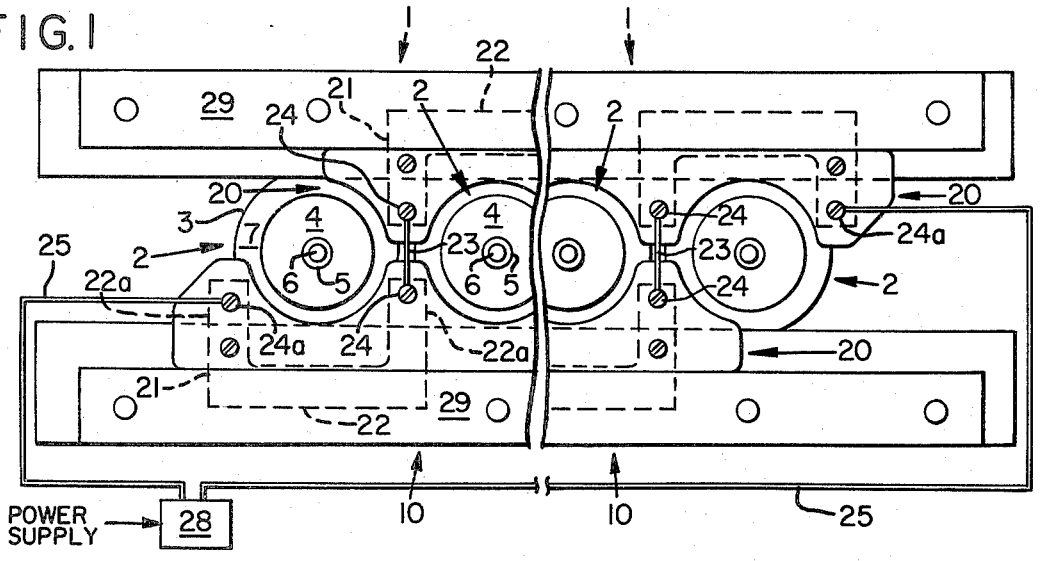

SYSTEM AND METHOD FOR CONTINUOUSLY PREVENTING FILAMENT BRIDGING BETWEEN ADJACENT DRAW NOZZLES

BACKGROUND OF THE INVENTION

This invention relates to a system and a method for continuously preventing bridging between filament draw nozzles used in the production of nonwoven fabrics.

Draw nozzles are commonly used in directing filaments to a desired location for nonwoven web formation. Compressed air generally supplied to the nozzles serves as an entraining medium for the filaments. Examples of prior art filament draw nozzles are described in U.S. Pat. No. 3,338,992 and U.S. Pat. No. 3,341,394, both to Kinney; Dorschner et al. patents, U.S. Pat. No. 3,665,862 and U.S. Pat. No. 3,692,618; U.S. Pat. No. 3,754,694 to Reba; and Reba patent application U.S. Ser. No. 192,973, now U.S. Pat. No. 4,332,027.

Filament draw nozzles such as described in U.S. Ser. No. 192,973 receive a filament bundle which is drawn downwardly from a spinning plate through a cooling chamber. Filament draw nozzles are located below filament spinning systems and are typically arranged in rows above a moving formation wire. The width of each of these rows depends on the width of the nonwoven fabric to be formed. The rows of draw nozzles extend in a cross-machine direction with respect to the formation wire. Adjacent draw nozzles are located at a distance one from the other which will facilitate uniform, nonwoven web formation, particularly in the machine direction, and avoid a substantial degree of streaking.

A combination of factors such as cooling air turbulence, excessive cross-flow velocity, improper air temperature, and/or various polymer melt properties, causes filament breakage prior to the filaments entering the nozzle throat. The broken filaments are suspended between adjacent nozzles causing "filament bridging" to occur. Once initiated by a single filament, bridging causes subsequently produced filaments to be continually collected until a filament aggregate structure is formed. When this snake-like structure dislodges itself from the bridged position, a phenomenon known as "filament shedding" occurs. This snake-like filament structure then passes through the nozzle system and causes a defect in the subsequently produced nonwoven web.

Another problem associated with filament bridging is defined as "filament diversion". In this latter situation, filaments from adjacent spinning systems are diverted into a single filament draw nozzle by the bridging filaments which act as a unidirectional flow path for the downwardly drawn filaments. Filament diversion can cause plugging of the draw nozzles to which all of the filaments are diverted, as in the case of the system described in the Dorschner patents, and/or streaking of the nonwoven web.

Therefore, it is an object of this invention to produce a system which will eliminate, or at least minimize, filament bridging across adjacent draw nozzles.

SUMMARY OF THE INVENTION

A system and method are accordingly provided for continuously preventing filament bridging between adjacent draw nozzles, thereby substantially eliminating the previously described problems associated therewith, including the forming of filament aggregate structures and filament diversion, respectively. By eliminating these formation problems, a more uniform, defect-free nonwoven web can be produced.

The system of the present invention comprises a heating element which is disposed between each of the adjacent draw nozzles. The draw nozzles are typically arranged in rows. These rows extend in a generally cross-machine direction with respect to a moving formation wire located below the draw nozzles. The heating element is positioned in the path of any filaments attempting to bridge an adjacent draw nozzle, and is preferably located at the level slightly higher than the inlet surface of the nozzle. The heating element is preferably disposed in the machine direction with respect to the formation wire. The temperature of each heating element is adjustable, and is maintained at a level high enough above the melting point of the filaments so that filaments contacting the heating element will be continuously and instantaneously melted. This, in turn, will continuously prevent filament bridge formation.

By employing the subject system and the method, several important advantages are provided. Since filament shedding and filament diversion are eliminated, (a) fewer operators are required to attend the equipment, (b) the allowable rate of reuseage of rejected nonwoven material in a polymer blend is increased to from about 20% to 30% by weight, and (c) the over-all quality of the nonwoven web is improved since defects in the web are eliminated, thereby reducing waste and further increasing the efficiency of polymer utilization.

BRIEF DESCRIPTION OF THE DRAWINGS

FIG. 1 is a plan view of a partial row of filament draw nozzle systems, including filament bridging prevention system 20, constructed in accordance with the teachings of the present invention.

FIG. 2 is an elevational view of one of the filament draw nozzles as depicted in FIG. 1.

FIG. 3 is a plan view of a pair of adjacent filament draw nozzles as depicted in FIG. 1, without filament bridging prevention system 20, having a filament bridging therebetween.

DETAILED DESCRIPTION OF THE INVENTION

FIGS. 1 and 2 illustrate a preferred form of a filament draw nozzle system 1, including a system 10 for continuously preventing filament bridging between adjacent draw nozzles 2. Systems 1 and 10, respectively are constructed in accordance with the teachings of the present invention. Filament draw nozzle 2 preferably comprise the nozzles described in U.S. patent application Ser. No. 192,973, filed Oct. 2, 1980, assigned to Crown Zellerbach Corporation, the assignee of the subject application. Rows of draw nozzles, generally extending in a cross-machine direction with respect to a formation wire 13, are preferably employed to produce nonwoven fabrics. The cross-directional extent of these rows is dependent on the width of the fabric desired.

Filament draw nozzle 2 of FIG. 1 receives a plurality of filaments 50 from a source (not shown), typically a spinneret which transports them downwardly through a draw pipe 11 (shown in fragmentary view) onto moving, nonwoven web formation wire 13, whereupon a nonwoven web 14 is formed. A foil element 40, of the type disclosed in U.S. patent application Ser. No.

115,308 may be disposed at the bottom of the draw pipe 11 to assist in the separation and distribution of the filaments 50.

The filaments can be produced from any known commercial polymeric material useful for producing, for example, nonwoven fabrics. Preferably, the polymeric material is a polyolefin, more preferably polypropylene.

Nozzle 2, as specifically depicted in FIG. 2, comprises a fiber feed tube 6 having a smooth cylindrical outer wall disposed within a housing 7. The interior of the tube 6 has a circular cross section. Feed inlet defining means 3 is provided which includes a body member 4 connected to the fiber feed tube 6. Body member 4 has formed therein a shallow bell-mouthed surface 5 leading to the interior of the fiber feed tube 6. The term "shallow" as applied to surface 5 means that the bell-mouthed surface formed in the body member 4 has a radius of curvature R not exceeding 150% of the inner diameter of the fiber feed tube 6. To control the extent to which the fiber feed tube is disposed within the throughbore, spacer means in the form of a ring 8 is positioned between fiber inlet defining means 3 and the top of housing 7. Fiber feed tube 6 may be raised or lowered by using different ring sizes. The nozzle 2 includes a throughbore means 9 (not shown) which extends downwardly therethrough. The filaments pass through tube 6, throughbore means 9, and tail pipe 15, and are transported downwardly through a draw pipe 11 to the forming wire 13, as previously described.

As depicted in detail in FIG. 2, the filament bridging prevention system 20 is provided. The system comprises a heating element 23, typically in the form of a wire which is positioned between adjacent draw nozzles. For example, a 24-gauge nickel-chromium wire may be employed for this purpose. The amount of current in the heating element is chosen so that a heating element temperature is maintained above the temperature at which the polymer melts, above the temperature at which any polymeric material accumulated on the heating element would be dissipated, and below the temperature at which the wire melts. The amount of current employed is a function of the wire diameter. Preferably, this is from about 3 to about 10 amps of current in the wire.

Heating element 23 is preferably located at a slightly higher elevation than the surface of the filament draw nozzle 2, and more specifically to the surface of the filament inlet defining means 3, so that any filament attempting to bridge across an adjacent nozzle will more readily contact heating element 23 and will be instantaneously melted, as described above. Heating element 23 is held in position by attachment to support members 21 (in phantom), which preferably have a low resistance with respect to electrical conductivity. Support members 21 are U-shaped, extend in a substantially cross-machine direction, and comprise a support base 22 having a pair of arms 22*a*, which extend generally in a machine direction from the ends thereof toward said nozzles. Heating element 23 is preferably disposed in a machine direction and attaches to support arms 22*a* located on either side of the rows of draw nozzles 2. The heating element is held in position by attachment means 24, generally in the form of screw means. A means for providing input current 25, generally in the form of an electric wire, attaches to one end of the support member 21 by attachment means 24*a* and at the other end to a power supply source 28, generally in the form of a power supply transformer. By adjusting the voltage of the power supply means 28, the requisite temperature is maintained in heating element 23 at a predetermined level. It is, however, essential that the temperature of heating element 23 may be maintained at a temperature sufficiently higher than the melting point of filaments 50 so that instantaneous melting of the filaments will occur when heating element 23 is contacted, but lower than the temperature which will cause instantaneous filament ignition. The melting point will vary with the type of polymer employed and with the filament thickness. Preferably, the temperature of the heating element 23 is maintained at about 150° F., more preferably at least about 200° F., and most preferably at least about 250° F., above the melting point of the filament polymer. For purposes of extended wire life, it is important, from a practical standpoint, to maintain as low a wire temperature as possible.

Support member 21 is maintained in position by attachment to support frame 29. Preferably, support frame 29 comprises a rail, preferably fabricated of a high density polymer such as high density polyethylene.

In order to minimize exposure to contact with heating element 23 so as to prevent accidental burns from being inflicted on the operator, it is preferred that a nonmetallic shield be attached to the heating element. Shield 30 is fabricated so that only a small portion of the wire is exposed, typically a portion narrower than a human finger.

In FIG. 3, adjacent draw nozzles 2 are pictured without filament bridging prevention system 20, as in the case of the prior art devices previously described. Filament 50 is shown for purposes of illustration, bridging said adjacent draw nozzles.

Referring again to FIG. 2, the system 1, in use, describes a method for continuously preventing filament bridging between adjacent draw nozzles 2 which comprises interposing heating element 23 between the nozzles 2. Heating element 23 is positioned in the path of filaments 50 attempting to bridge adjacent draw nozzles 2. The temperature of heating element 23 is adjustably maintained at a level high enough above the melting point of the filaments so that filaments contacting the heating element will be continuously and instantaneously melted, and filament bridging is avoided.

We claim:

1. A method for continuously preventing filament bridging between adjacent draw nozzles which comprises:

(a) interposing a heating element between said adjacent draw nozzles and positioning same in the path of filaments attempting to bridge said adjacent draw nozzles; and (b) adjustably maintaining the temperature of said heating element at a level high enough above the melting point of the filaments so that filaments contacting said heating element will be continuously and instantaneously melted.

2. The method of claim 1, wherein said heating element is positioned at a level slightly higher than the inlet surface of said adjacent draw nozzles.

3. The method of claim 1, wherein the filaments are deposited onto a moving formation wire from the draw nozzles, the nozzles being arranged in rows which extend in a cross-machine direction with respect to said formation wire, and said heating element extends in a machine direction with respect to said formation wire between said adjacent draw nozzles.

4. The method of claim 1, wherein the temperature of the heating element is maintained at least about 150° F. above the melting point of the filament polymer.

5. A system for continually preventing filament bridging between adjacent draw nozzles, which comprises a heating element disposed between each of said adjacent draw nozzles and positioned in the path of filaments attempting to bridge said nozzles, the temperature of said heating element being adjustably maintained at a level high enough above the melting point of the filaments so that filaments contacting said heating element will be continuously and instantaneously melted.

6. The system of claim 5, wherein said heating element is positioned at a level slightly higher than the inlet surface of the adjacent draw nozzles.

7. The system of claim 5, wherein the filaments are deposited onto a moving formation wire from the draw nozzles, the nozzles being arranged in rows which extend in a cross-machine direction with respect to said formation wire, and said heating element extends in a machine direction with respect to said formation wire between said adjacent nozzles.

8. The system of claim 5, wherein said heating element comprises a metallic heating wire.

9. The system of claim 5, wherein the temperature of the heating element is maintained at least about 150° F. above the melting point of the filament polymer.

10. The system of claim 9, wherein said heating temperature is maintained at least about 200° F. above said melting point.

* * * * *